US006276185B1

(12) United States Patent
Owens

(10) Patent No.: US 6,276,185 B1
(45) Date of Patent: Aug. 21, 2001

(54) FLOW LOCK BEAD CONTROL APPARATUS AND METHOD FOR DRAWING HIGH STRENGTH STEEL

(75) Inventor: Herbert W. Owens, Clarkston, MI (US)

(73) Assignee: General Motors Corporation, Detroit, MI (US)

( * ) Notice: Subject to any disclaimer, the term of this patent is extended or adjusted under 35 U.S.C. 154(b) by 0 days.

(21) Appl. No.: 09/457,145

(22) Filed: Dec. 9, 1999

(51) Int. Cl.[7] ..... B21D 22/22
(52) U.S. Cl. ..... 72/350
(58) Field of Search ..... 72/347, 350, 351

(56) References Cited

FOREIGN PATENT DOCUMENTS 58-181432 * 10/1983 (JP) ..... 72/347
64-27726 * 1/1989 (JP) ..... 72/350
3-71932 * 3/1991 (JP) ..... 72/351

* cited by examiner

*Primary Examiner*—Lowell A. Larson
(74) *Attorney, Agent, or Firm*—Charles E. Leahy

(57) ABSTRACT

Forming apparatus includes a binder with novel flow lock beads that engage edge portions of a sheet metal blank during metal drawing. In an initial step, the beads draw inner portions of the edge portions into a die cavity to partially form a component. In a second step, the beads are inserted into bead recesses in an opposing die, locking the edge portions in place and causing stretching of the metal in a final portion of the drawing stroke. Stresses in the resulting component are relieved by the stretching process which may be selectively used in forming a component with varying draw depths across its length.

5 Claims, 6 Drawing Sheets

FLOW LOCK BEAD CONTROL APPARATUS AND METHOD FOR DRAWING HIGH STRENGTH STEEL

TECHNICAL FIELD

This invention relates to a method and apparatus for drawing high strength steel in a conventional forming press.

BACKGROUND OF THE INVENTION

It is known in the art of metal forming to form deep drawn three dimensional sheet metal structures for automobile body components and the like using a conventional forming press and drawing dies working with low carbon steels of an adequate gauge or thickness.

In order to provide lighter structures for forming or supporting body components, it has long been desired to utilize high strength steels of thinner gauge to replace the components currently formed from low carbon steel. However, the use of high strength steels has not previously been successfully accomplished where significant drawing of the metal is required since the resulting product is deformed due to internal stresses in the high strength steel which are not relieved in the forming process.

SUMMARY OF THE INVENTION

The present invention provides an apparatus and method for successfully drawing high strength steel to form relatively light weight structural members for automobile bodies and the like with a high degree of accuracy in the resulting component. The invention involves a two-step process wherein a blank, which may be flat or preformed to a desired shape, is first partially drawn in a forming press while binder edge portions of the blank are drawn across flow restricting beads in a press binder to allow drawing of metal into a die cavity by an associated punch to form a partially completed structure. The process is completed by forcing the beads further into associated die cavities to lock the binder edges of the blank so that the final portion of the forming process is limited to working the metal of the blank by stretching it into the final shape, sufficient working being accomplished to develop yielding of the metal which avoids subsequent warping or distortion of the finished component upon removal from the die.

The forming apparatus includes mating upper and lower dies, the lower die assembly including a binder having novel flow lock beads. In an initial predetermined portion of the stroke of the press, the beads are positioned to apply a restraining force while allowing metal from the binder edges to flow into the die cavity. Upon further movement of the press toward the final forming position, the beads are forced upward into associated 10 cavities. This locks the edges of the blank against further flow, causing the final forming step to stretch the metal so that it yields and forms a smooth drawn structure with stresses relieved to avoid subsequent distortion of the part.

In a preferred embodiment, the apparatus includes a drawing die with a mating punch and binder, the die and binder having opposing binder edge engaging portions. The die includes a bead recess opposing a bead carrying pocket in the binder. At least one adjustable bead is received in the pocket, having an initial metal restraining position. Transfer means in the binder move the bead to a second position during relative motion of the die and punch to lock the associated binder edge of the blank in position for final forming and working of the metal to a smooth stress relieved component.

These and other features and advantages of the invention will be more fully understood from the following description of certain specific embodiments of the invention taken together with the accompanying drawings.

DESCRIPTION OF THE PREFERRED EMBODIMENT

Figure 1:
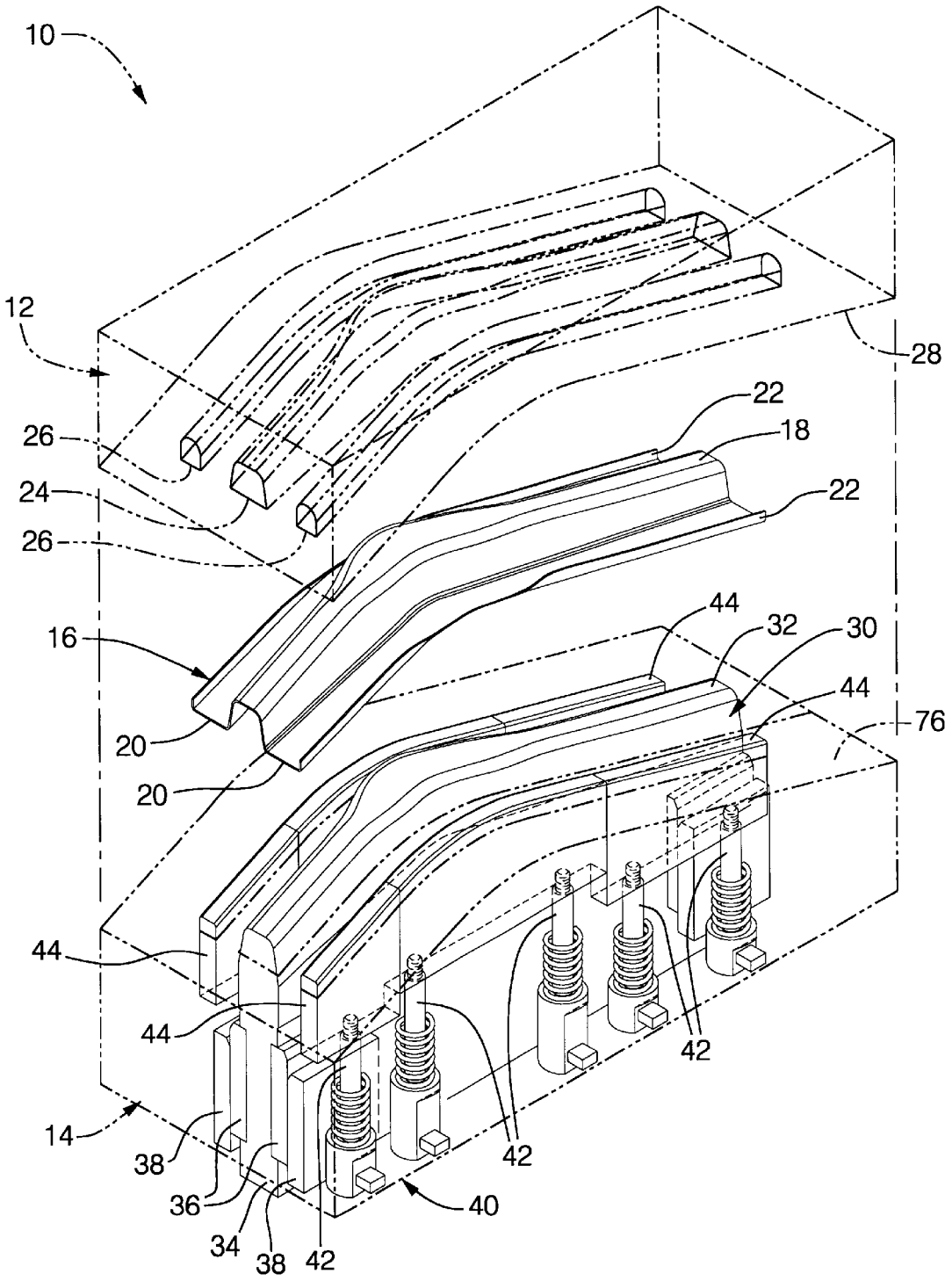
FIG. 1 is a semi-schematic pictorial view illustrating elements of associated upper and lower dies according to the invention and a drawn component formed thereby.
Figure 2:
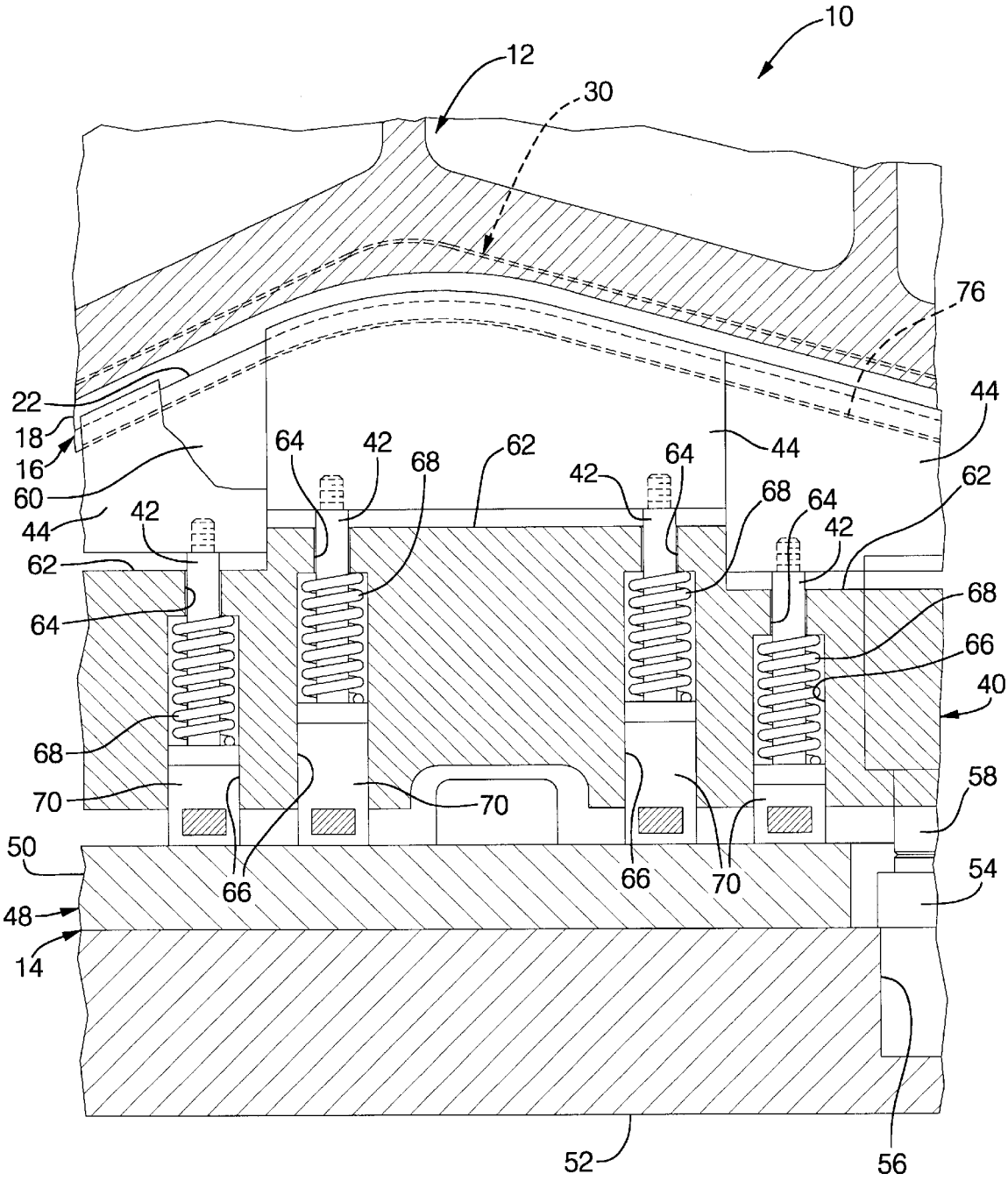
FIG. 2 is a fragmentary longitudinal cross-sectional view through a binder portion of the lower and upper dies in their closed position.

Referring first to FIG. 1 of the drawings, numeral 10 schematically indicates an assembly of an upper die 12, a lower die 14 and a formed engine cradle member 16 disposed between the dies. The formed cradle member 16 includes a U-shaped longitudinal beam portion 18 extending the length of the component and having varying width and depth dimensions over its length. Lateral binder edge portions 20 extend outward from the edges of the U-shaped channel and terminate in upturned binder lock portions 22.

The upper die 12 includes a central die cavity 24 for receiving and forming the beam portion 18 of the cradle member. Bead recesses 26 are spaced laterally on either side of the die cavity 24 and extend generally parallel therewith. The die 14 has a lower surface 28 which is arched to provide the slightly bowed shape of the formed cradle member 16.

The lower die 14 includes a central punch 30 having a U-shaped upper edge 32, configured to form the inner surface of the U-shaped portion of cradle member 16. The punch also includes a lower end 34 and an intermediate portion carrying guide shoes 36 that in turn slidingly engage guide plates 38 received in a binder 40 carried in the lower die 14 for guiding relative motion of the punch within the binder.

The binder carries a plurality of transfer means including transfer pins 42 threadably engaging movable beads 44 which are laterally spaced on opposite sides of the punch upper edge 32 and are adapted to be received in the bead recesses 26 of the upper die.

FIGS. 2–6 illustrate the structure of the die assembly 10 of FIG. 1 together with additional structural features. A die shoe 48 is mounted on the base of a conventional forming press, not shown. The die shoe 48 includes a shelf 50 that supports the lower end 34 of the die punch 30. A nitrogen manifold 52 is attached to the bottom of the shelf 50. Pneumatic cylinders 54 are fixed in threaded pockets 56 of the manifold 52 and have pistons 58 which extend upward through openings in the shelf 50 to support the binder 40 that surrounds the punch 30.

Figure 3:
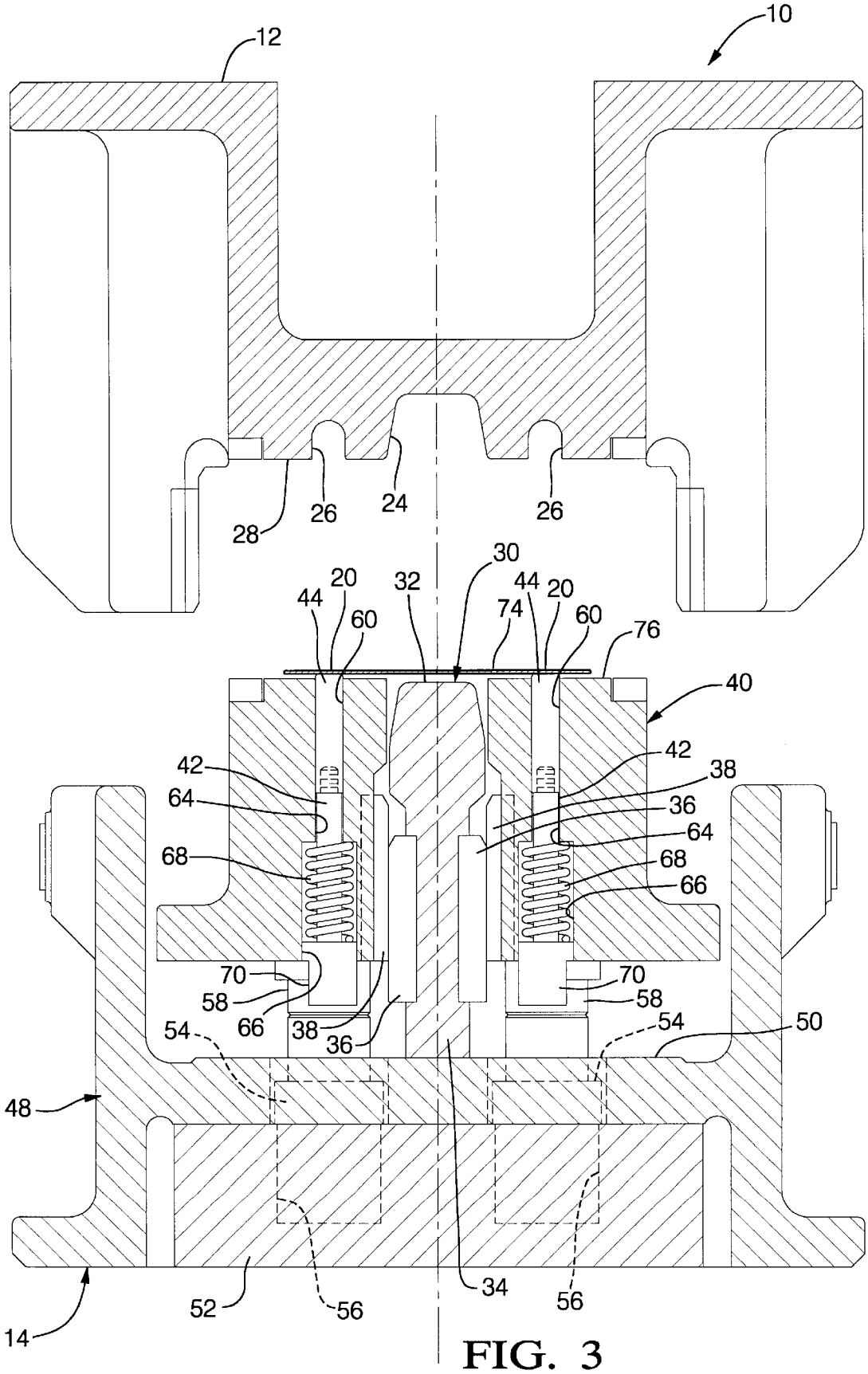
FIG. 3 is a transverse cross-sectional view through the dies showing the original blank in position for forming.
Figure 4:
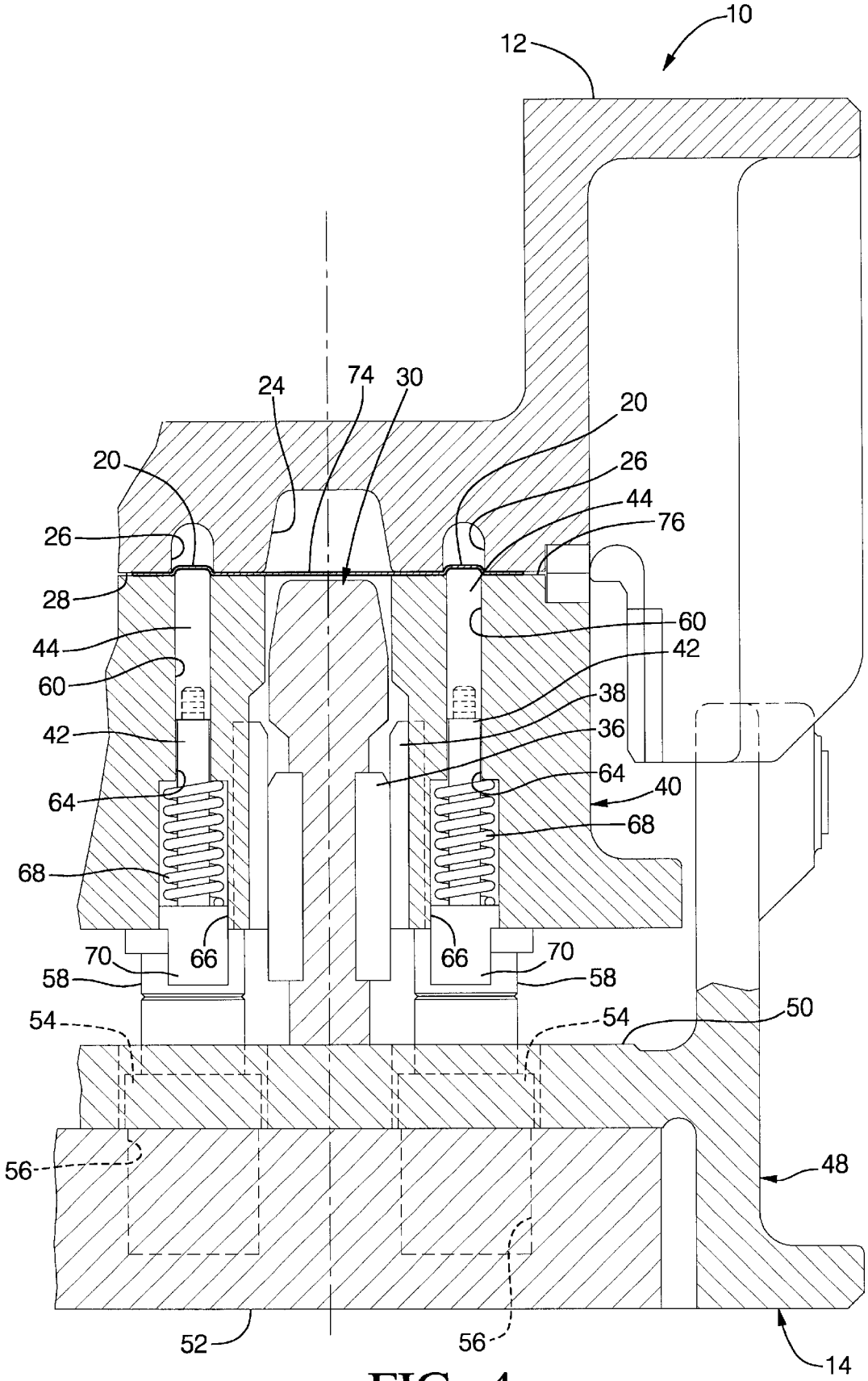
FIG. 4 is a view similar to FIG. 3 but showing the upper die lowered to clamp the blank against the binder.
Figure 5:
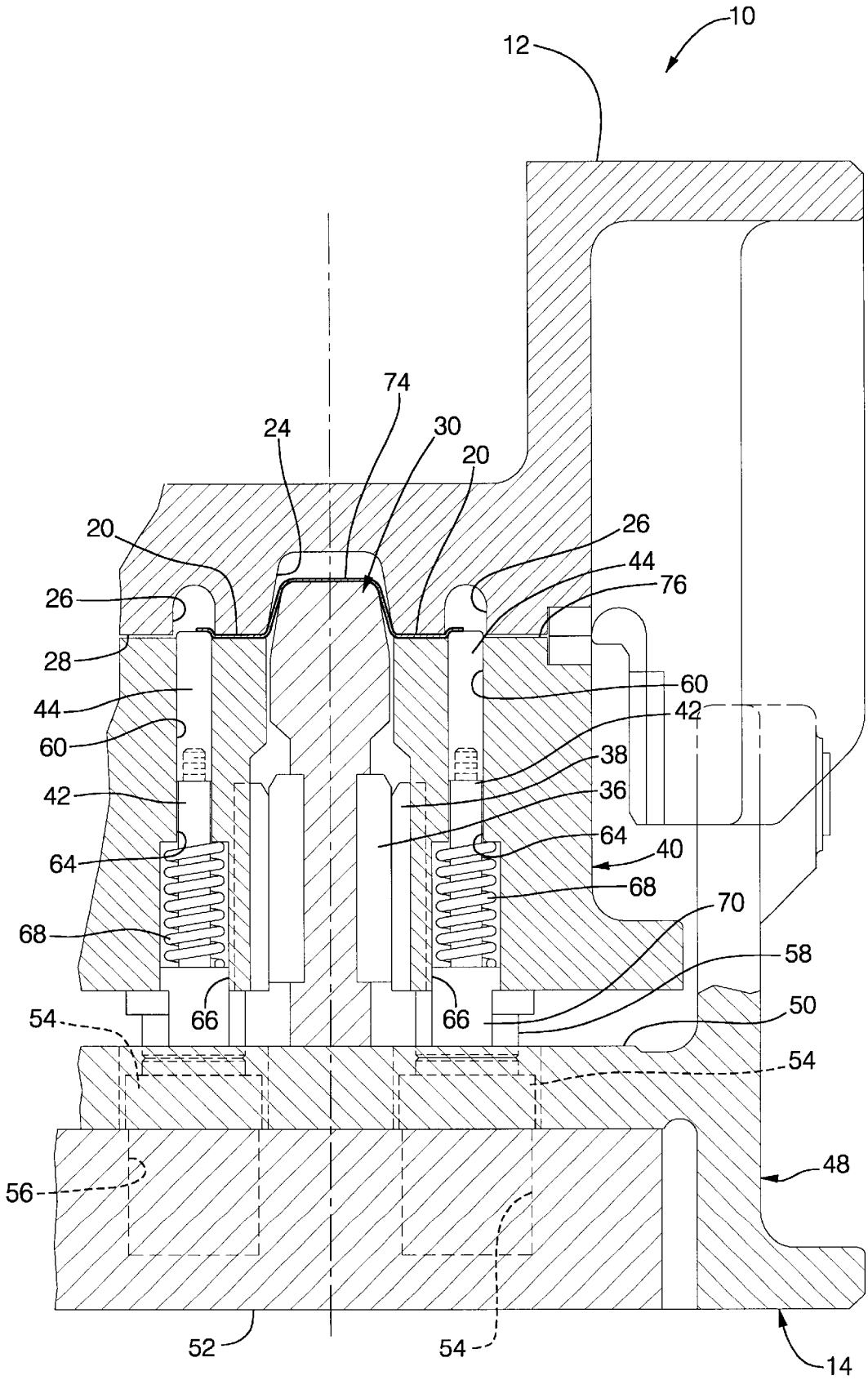
FIG. 5 is a view similar to FIG. 4 showing the die lowered to a partially formed condition of the blank with the beads positioned for subsequent upward movement.
Figure 6:
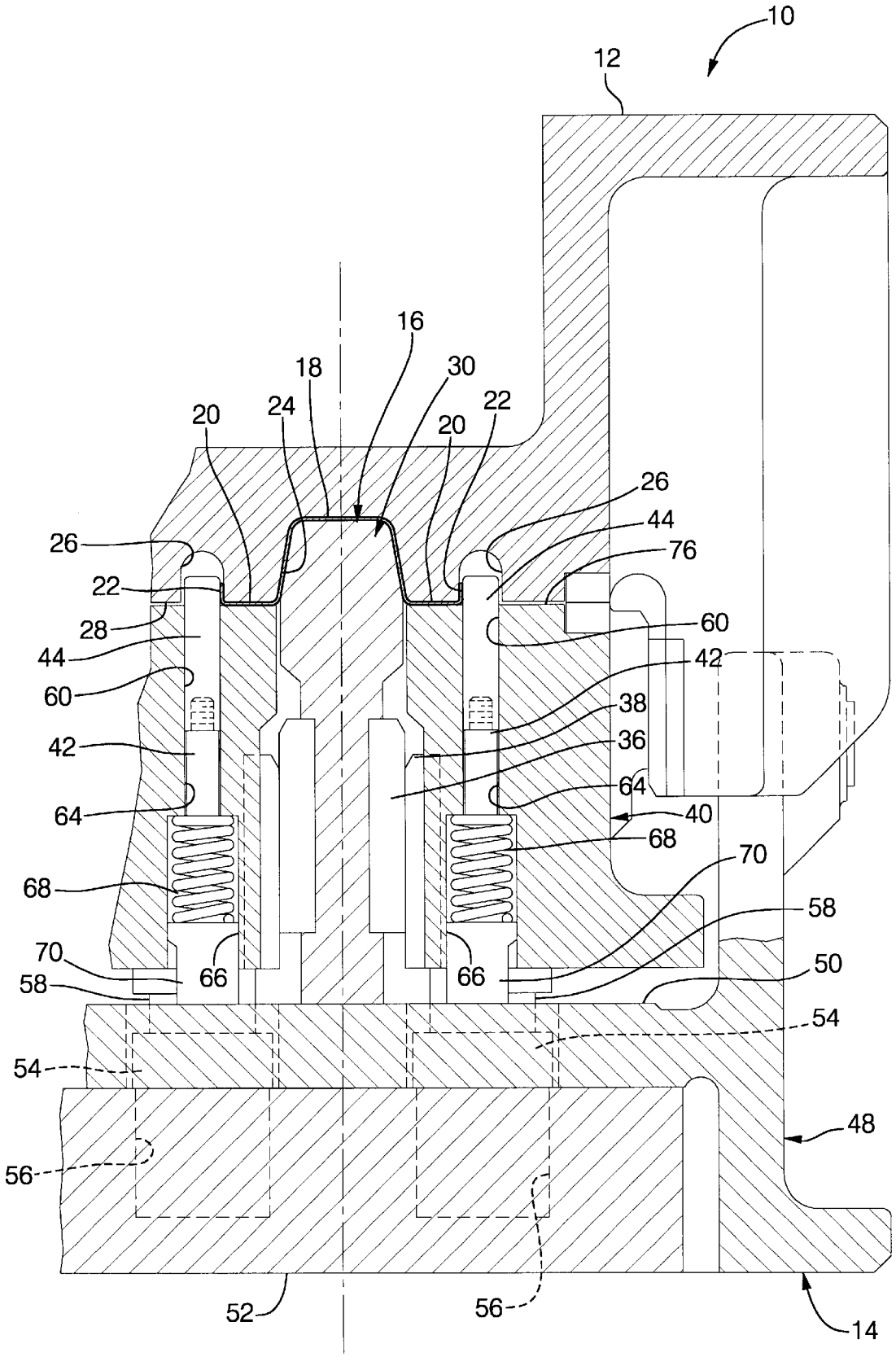
FIG. 6 shows the dies at the completion of the drawing stroke with the beads raised to lock the binder edge portions in place while the final portion of the forming step is being completed.

The separate beads 44 are received in slots 60 which are formed in the binder and have stepped upper surfaces 62 that are engaged by bottom edges of the individual beads 44 when in their lower positions, as shown in FIGS. 3–5. The transfer pins 42 extend up through cylindrical openings 64 from enlarged pockets 66 containing return springs 68. The springs are compressed in the pockets 66 against heads 70 on the lower ends of the transfer pins 42. The springs 68 urge the transfer pins downward so as to normally retract the beads 44 against the upper surfaces 62 of the binder. The pneumatic cylinders 54 always bias the binder 40 upward toward its initial position, shown in FIG. 3, but the binder is forced downward by engagement of the upper die until the heads 70 of the transfer pins engage the shelf 50.

FIGS. 3–6 show sequential steps in the movement of the upper die and binder components during drawing of the cradle member 16. In FIG. 3, the upper die 12 is shown fully raised for placement of a high strength sheet metal blank 74 on the curved upper surface 76 of the binder. The blank may be precurved, if desired, to fit the upper surface of the binder but instead is preferably flat and held in place by retractable edge retainers, not shown. After placement of the blank 74, the upper die is lowered in a continuous stroke which first reaches the position shown in FIG. 4 where the upper die lower surface 28 engages the sheet metal blank 74 and clamps the blank against the curved upper surface 76 of the binder. Since the beads 44 are held by the transfer pins in a position extending slightly above the surface of the binder, the beads 44 extend a small amount up into recesses 26 of the upper die. Thus, the binder edge portions 20 of the blank are deformed slightly upwardly and are restrained between the opposing surfaces of the binder and upper die by a predetermined force, as well as by the slight deformation of the edge portions 20.

FIG. 5 illustrates a further downward motion of the upper die which causes the punch 30 to enter partially into the die cavity 24, forcing the sheet metal upward into the cavity. During this process, metal from the binder edge portions 20 is drawn across the tops of beads 44 and partially into the die cavity to allow drawing to take place without excessively stressing the metal. Also, at this point, the heads 70 of the transfer pins have been lowered with the binder so that the heads 70 engage the shelf 72 of the die shoe.

The transfer pins 42 and the attached beads 44 are thus bottomed out so that when the upper die 12 moves further downward to complete its stroke, the binder moves down with it but the beads 44 do not. Instead, the beads move upward relative to the downwardly moving binder 40. The beads, thus enter the recesses 26 and bend over the outer edges of the binder edge portions 20 to form the upwardly extending lock portions 22. This locks the flanges in place so that the final motion of the upper die and binder downward to the position shown in FIG. 6 completes drawing of the high strength sheet metal by stretching the metal sufficiently to work the metal beyond its yield point and thereby reduce retained stresses in the metal. This stretching process also smoothes out wrinkles in the metal itself and thus provides a very clean and stress free sheet metal member which retains its shape without distortion when the upper die is retracted and the part may be removed.

If desired, when forming components with variable draw depths or for other reasons as appropriate, portions of the blank flanges 20 may be cut away in advance so that they are drawn past the beads in the drawing step and are not locked in place as are other portions of the blank. For example, note that binder lock portions 22 are formed only on the shallower drawn end portions of the cradle member 16. These end portions are locked by the beads 44 during final drawing of the component 16, as previously described. The central portions of the binder edge portions of the blank 20 are cut away so that they are not locked by the beads. This is desirable because the deeper draw in the central portion of the component 16 works the metal adequately without additional stretching of the metal. If desired, the same result may be obtained by omitting the movable beads from the parts of the binder where locking of the edge portions 20 is not desired.

While the invention has been described by reference to certain preferred embodiments, it should be understood that numerous changes could be made within the spirit and scope of the inventive concepts described. Accordingly it is intended that the invention not be limited to the disclosed embodiments, but that it have the full scope permitted by the language of the following claims.

What is claimed is:

1. Apparatus for drawing high strength steel in a forming press, said apparatus comprising:

a drawing die having a peripheral binder-engaging portion;

a punch aligned for mating with the die;

a binder mating with said peripheral binder-engaging portion of the die and adapted to receive an edge portion of a metal workpiece between the die and the binder;

at least one bead recess in the die and extending along at least part of the binder-engaging portion;

at least one bead-carrying pocket in the binder and opening toward the bead recess in the die;

at least one adjustable bead received in the pocket and movable between a first position, in which the bead is seated in the pocket and protrudes therefrom into the bead recess of the die by selected amounts for working metal of the workpiece edge portion drawn across the bead during a predetermined portion of a drawing stroke of the punch, and a second position in which the bead extends a predetermined additional dimension out of the pocket and into the bead recess of the die for deforming part of the edge portion into the bead recess and locking the edge portion against further drawing of the metal into the die; and transfer means in the binder for moving the at least one bead between said first and second positions during the drawing stroke of the punch.

2. Apparatus as in claim 1 wherein said transfer means includes at least one transfer pin in the binder having one end engagable with said bead and an other end engagable with a stop upon movement of the binder to a predetermined position during said stroke of the punch, further motion of the binder forcing the transfer pin axially in the binder and driving the bead toward said second position.

3. Apparatus as in claim 2 wherein said first end of the transfer pin is attached to said bead, the apparatus further including return means operative to return the transfer pin and the attached bead to the first position of the bead when the punch and die are drawn apart.

4. Apparatus as in claim 3 wherein said transfer pin includes a head on said other end and said return means includes a spring compressed in a pocket of the binder between said head and an end of the binder pocket and biasing the binder toward said first position.

5. A method for drawing high strength steel in a forming press, said method comprising;

restraining edge portions of a sheet metal blank of the steel with a preset resistance during an initial portion of a drawing stroke in which metal from the edge portions is drawn into an associated die cavity under a preestablished tensile load; and locking the edge portions in fixed positions during a final portion of said drawing stroke to strain the metal sufficiently to establish a final shape without substantial subsequent distortion; wherein said restraining step is performed by engagement of the edge portions by bead recesses and movable beads in a first position allowing drawing of the edge portions through the beads with predetermined restraint, and said locking step is performed by advancing the beads to a second position extending into the bead recesses sufficiently to lock the edge portions and prevent further motion of the edge portions through the beads.

* * * * *